US006634337B2

(12) United States Patent
Akagi et al.

(10) Patent No.: US 6,634,337 B2
(45) Date of Patent: Oct. 21, 2003

(54) STRUCTURE OF ARRANGING FUEL INJECTION VALVE OF ENGINE

(75) Inventors: Takashi Akagi, Saitama (JP); Hiroatsu Inui, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 106 days.

(21) Appl. No.: 09/949,749

(22) Filed: Sep. 12, 2001

(65) Prior Publication Data

US 2002/0029763 A1 Mar. 14, 2002

(30) Foreign Application Priority Data

Sep. 12, 2000 (JP) ..... 2000-277186

(51) Int. Cl.[7] ..... F02M 1/00
(52) U.S. Cl. ..... 123/470; 123/432
(58) Field of Search ..... 123/302, 305, 123/432, 470

(56) References Cited

U.S. PATENT DOCUMENTS 5,174,260 A * 12/1992 Nonogawa et al. ..... 123/432
5,224,458 A * 7/1993 Okada et al. ..... 123/531
5,329,905 A * 7/1994 Kawaguchi et al. ..... 123/472
5,462,027 A * 10/1995 Aoyama ..... 123/432
5,463,995 A * 11/1995 Sakai et al. ..... 123/432
5,915,358 A * 6/1999 Muller ..... 123/432
5,957,096 A * 9/1999 Clarke et al. ..... 123/90.15
6,009,849 A * 1/2000 Yamamoto et al. ..... 123/298
6,173,693 B1 * 1/2001 Ladell et al. ..... 123/305

* cited by examiner

*Primary Examiner*—John Kwon
(74) *Attorney, Agent, or Firm*—Birch, Stewart, Kolasch & Birch, LLP

(57) ABSTRACT

Axis lines of first and second fuel injection valves are offset from first and second cylinder center lines of first and second combustion chambers by way of moving the first and second fuel injection valves along cam shafts by constituting limits by bringing fuel injection ranges of the first and second fuel injection valves to inner walls of opening portions. Even when the positions of the intake manifolds are obliged to move along the cam shafts, fuel injected from the fuel injection valves can be made to be difficult to adhere to the inner walls of the opening portions and vaporization of fuel can be expedited. Therefore, a mixture in the combustion chambers can be made uniform and engine performance such as response performance of engine rotation, fuel consumption, exhaust gas properties, occurrence of knocking or the like when the throttle valve is opened, can be improved.

20 Claims, 4 Drawing Sheets

STRUCTURE OF ARRANGING FUEL INJECTION VALVE OF ENGINE

CROSS-REFERENCE TO RELATED APPLICATIONS

The present application claims priority under 35 USC 119 to Japanese Patent Application No. 2000-277186 filed on Sep. 12, 2000 the entire contents thereof is hereby incorporated by reference.

BACKGROUND OF THE INVENTION

1. Field of the Invention

The present invention relates to a structure of arranging a fuel injection valve of an engine preferable for improving engine performance regardless of the layout of the engine parts.

2. Description of Background Art

FIG. 4 is a sectional view showing a fuel injection state of a conventional engine and showing a state in which an intake manifold 101 is attached to a cylinder head 100, a fuel injection valve 102 is attached to the intake manifold 101 and fuel 104 is injected from the fuel injection valve 102 into an intake path 103 provided adjacent to the cylinder head 100. An intake side valve seat opening portion 105 of the intake path 103 is provided that leads to a combustion chamber 106. An intake valve 107 is provided for opening and closing the opening portion 105. An exhaust path 108 is provided with an exhaust side valve seat opening portion 111 of the exhaust path 108 leading to the combustion chamber 106. An exhaust valve 112 is provided for opening and closing the opening portion 111.

FIG. 5 is a view taken along the arrow 5 direction in FIG. 4. FIG. 5 illustrates an arrangement of the intake manifold 101 such that the center of an outlet 101*a* thereof coincides with a center line 113 of the combustion chamber 106. The fuel injection valve 102 of a two-direction injection type is arranged such that an axis line thereof coincides with the center line 113 of the combustion chamber 106. Portions of the fuel 104 are sprayed toward two of the opening portions 105 in line with a cam shaft 114 indicated by an imaginary line.

For example, there is a case in which the intake manifold 101 cannot be arranged to coincide with the center line 113 of the combustion chamber 106 for attaching an ignition plug or other engine parts to the cylinder head 100 or for some other reason, in such a case, the intake manifold 101 is attached to the cylinder head 100 by moving the intake manifold 101 in a direction along the cam shaft 114. In accordance therewith, when the fuel injection valve 102 is also moved in the direction of the arrow in FIG. 5 and the injection ranges of the portions of fuel 104 are changed, an amount of the injected fuel which adheres to inner walls of the opening portions 105, is increased and the fuel becomes difficult to vaporize. Therefore, a mixture in the combustion chamber becomes non-uniform, which has an influence on the output performance of the engine.

SUMMARY AND OBJECTS OF THE INVENTION

Hence, it is an object of the present invention to improve engine performance regardless of the layout of the engine parts by reforming a structure of arranging a fuel injection valve of an engine.

According to the present invention, a structure is provided for arranging a fuel injection valve of an engine characterized in that in an engine a fuel injection valve of a 2-direction injection type is attached to an intake manifold for injecting fuel into a combustion chamber having two intake holes aligned along a cam shaft. An axis line of the fuel injection valve is offset from a center of the combustion chamber by moving the fuel injection valve along the cam shaft to limit an injection range of the fuel injection valve as the fuel contacts with an inner wall of the intake hole.

By offsetting the axis line of the fuel injection valve from the center of the combustion chamber along the cam shaft by constituting the limit by bringing the injection range of the fuel injection valve into contact with the inner wall of the intake hole, even when a position of the intake manifold is obliged to move along the cam shaft, the fuel injected from the fuel injection valve can be made to be difficult to adhere to the inner wall of the intake hole and vaporization of the fuel can be expedited. Therefore, a mixture in the combustion chamber can be made uniform and engine performance such as response performance of engine rotation, fuel consumption, exhaust gas properties, occurrence of knocking or the like when the throttle valve is opened can be improved.

According to the present invention, the engine is a V-type 2-cylinder engine offsetting respective cylinders from each other in a crankshaft direction and arranged with a throttle body for two of the cylinders on one side of the engine in the crankshaft direction, a first fuel injection valve facing a first combustion chamber proximate to the throttle body is offset in a direction of being remote from the throttle body and a second fuel injection valve facing a second combustion chamber remote from the throttle body is offset to a side of the throttle body.

According to the V-type 2-cylinder engine offsetting the respective cylinders from each other in the crankshaft direction and arranging the throttle body for the two cylinders on one side of the engine in the crankshaft direction, respective lengths of the intake manifolds connected to the respective cylinders differ from each other and accordingly, a difference is produced in intake air amounts of the respective combustion chambers, by unbalance in outputs among the cylinders, it is difficult to increase output. However, for example, in the case in which in order to prolong the short intake manifold provided on the side of the first combustion chamber, an outlet of the intake manifold on a side of the intake path is moved in a direction of being remote from the throttle body and in order to shorten the intake manifold on the side of the second combustion chamber longer than the intake manifold on the side of the first combustion chamber, an outlet of the intake manifold on the side of the intake path is moved to the side of the throttle body to thereby reduce a difference in the respective lengths of the intake manifolds, when the first fuel injection valve is offset in the direction of being remote from the throttle body and the second fuel injection valve is offset to the side of the throttle body, while improving engine performance such as response performance of engine rotation, fuel consumption, exhaust gas properties, occurrence of knocking or the like when the throttle valve is opened, an increase in engine output can be achieved by substantially equal length formation of the respective intake manifolds.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An explanation will be given of embodiments of the present invention in reference to the attached drawings as follows. Further, the drawings are viewed in directions of notations.

Figure 1:
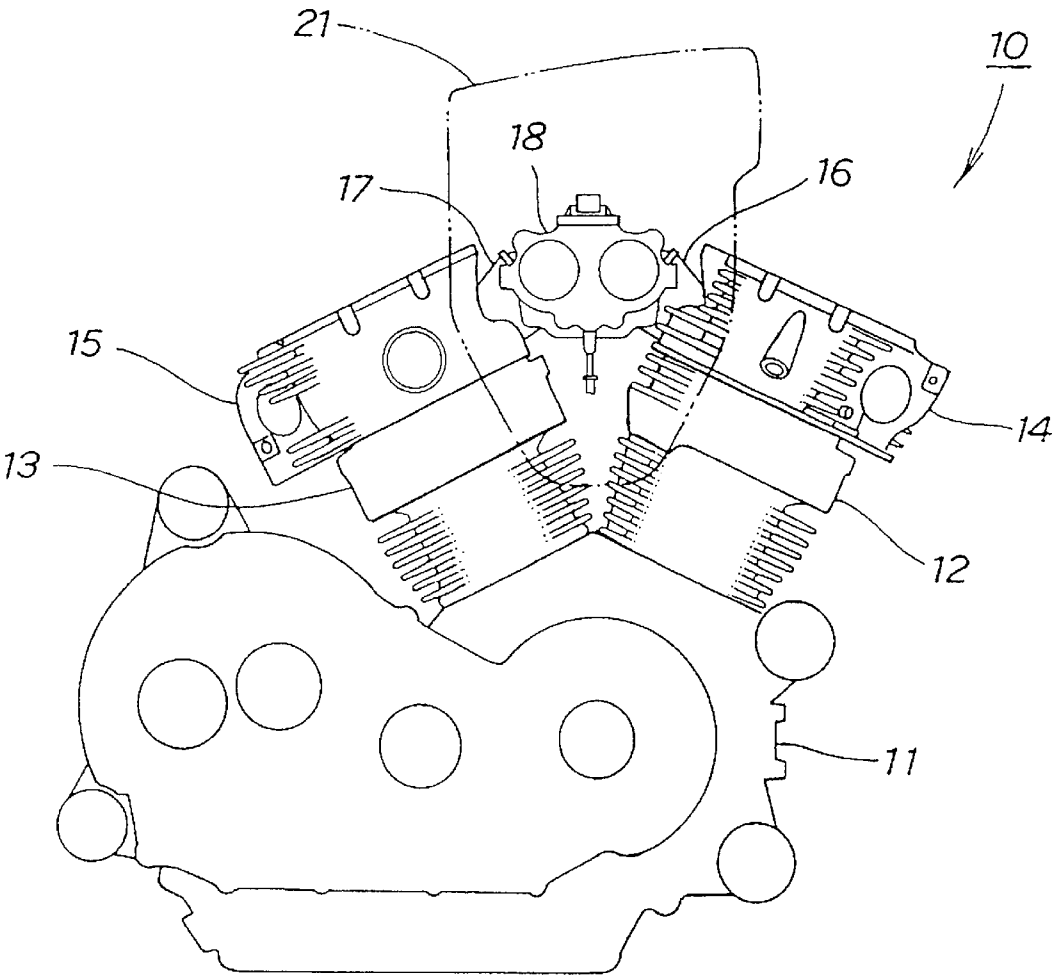
FIG. 1 is a side view of an engine adopting a fuel injection valve structure according to the invention.

FIG. 1 is a side view of an engine adopting a fuel injection valve structure according to the present invention and an engine 10 is a V-type two-cylinder engine in which a first cylinder block 12 and a second cylinder block 13 are attached to upper portions of a crankcase 11, a first cylinder head 14 and a second cylinder head 15 are respectively attached to upper portions of the first and the second cylinder blocks 12 and 13. A throttle body 18 for the two cylinders is attached to the first and the second cylinder heads 14 and 15 via a first and a second intake manifold 16 and 17. An air cleaner 21 is attached to the throttle body 18.

The V-type engine 10 includes a cylinder having an included angle smaller than 90. Thus, it is difficult to arrange the throttle body 18 between the first and the second cylinder heads 14 and 15. Therefore, the throttle body 18 is arranged further on the near side of the first cylinder head 14 projecting out of the drawing.

The first cylinder block 12 and the first cylinder head 14 are on the side of the first cylinder and the second cylinder block 13 and the second cylinder head 15 are on the side of the second cylinder.

Figure 2:
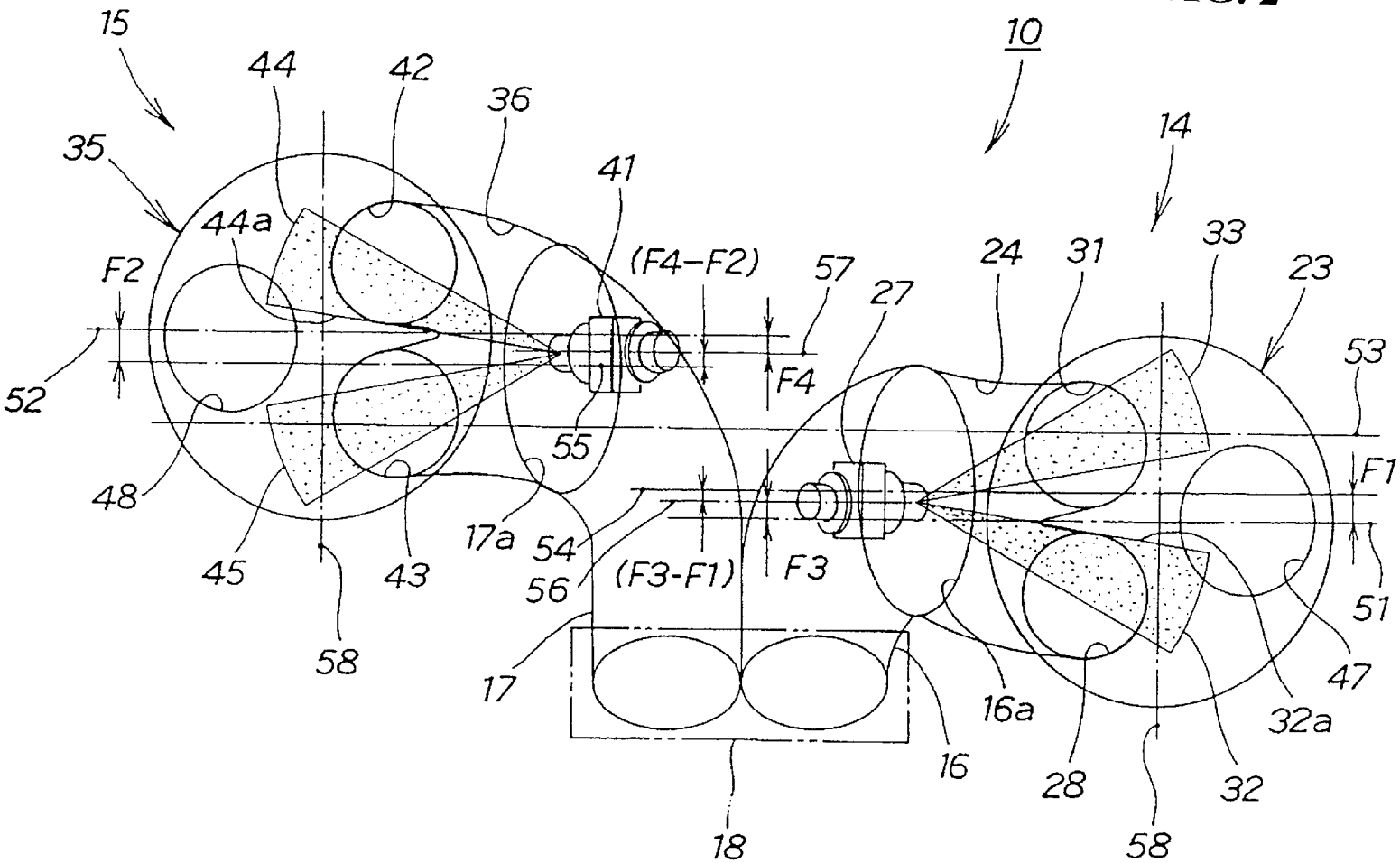
FIG. 2 is a plane view of essential portions of an engine showing a structure of arranging a fuel injection valve according to the present invention.
Figure 5:
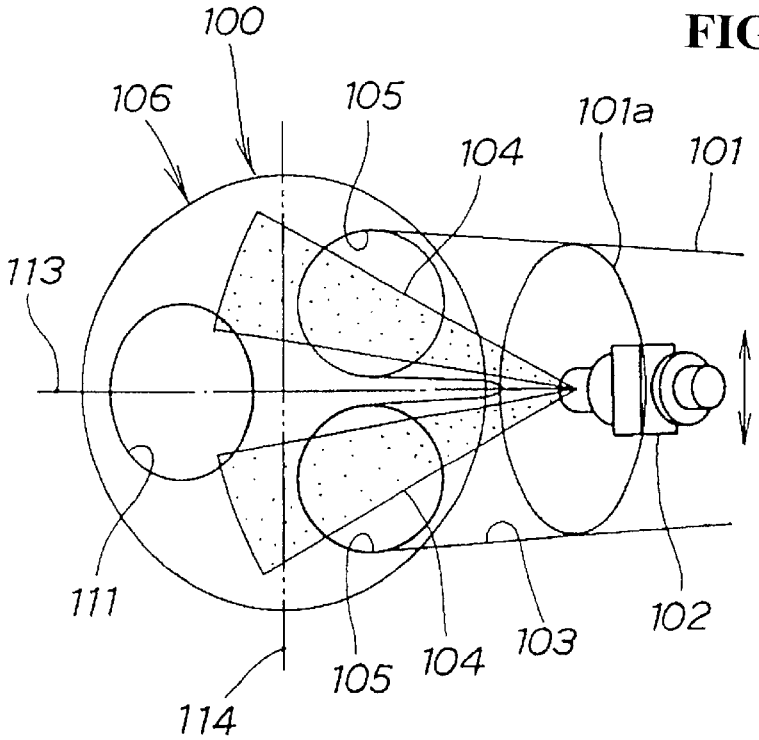
FIG. 5 is a view taken in the direction of arrow 5 in FIG. 4.

FIG. 2 is a plane view of essential portions of the engine showing a structure of arranging a fuel injection valve according to the invention and showing a state in which an intake path 24 communicating with a first combustion chamber 23 is provided to the first cylinder head 14. A first fuel injection valve 27 is attached to the first intake manifold 16. Portions of fuel 32 and 33 are injected from the first fuel injection valve 27 toward opening portions 28 and 31 as intake holes of the intake path 24 opened to the first combustion chamber 23. Further, an intake path 36 communicating with a second combustion chamber 35 is provided to the second cylinder head 15. A second fuel injection valve 41 is attached to the second intake manifold 17, and portions of fuel 44 and 45 are injected from the second fuel injection valve 41 toward opening portions 42 and 43 as intake holes of the intake path 36 opened to the second combustion chamber 35. (A method of illustrating the cylinder heads, the intake manifolds and the fuel injection valves is similar to that in FIG. 5.)

An opening portion 47 of an exhaust path is opened to the first combustion chamber 23. An opening portion 47 of an exhaust path is opened to the second combustion chamber 35. First and a second cylinder center line 51 and 52 are illustrated for indicating centers of the first and second combustion chambers 23 and 35. An engine center line 53 is located at the center between the first and the second cylinder center lines 51 and 52. First and a second intake manifold center lines 54 and 55 are illustrated for indicating centers of outlets 16*a* and 17*a* of the first and the second intake manifolds 16 and 17 respectively connected to the intake paths 24 and 36. Axis lines 56 and 57 are provided for the first and the second fuel injection valves 27 and 41. In addition, axis lines 58 are provided for cam shafts.

The first combustion chamber 23 is arranged on the side of the throttle body 18 relative to the engine center line 53 and the second combustion chamber 35 is arranged on a side opposed to the throttle body 18 relative to the engine center line 53.

Further, the first intake manifold center line 54 of the first intake manifold 16, is offset to the side of the engine center line 53 relative to the first cylinder center line 51 by a (first predetermined distance F1 and the second intake manifold center line 55 of the second intake manifold 17, is offset to the side of the engine center line 53 relative to the second cylinder center line 52 by a second predetermined distance F2.

Further, the first fuel injection valve 27 is offset to the side of the engine center line 53 relative to the first cylinder center line 51 by a third predetermined distance F3 and is offset to the side opposed to the engine center line 53 relative to the first intake manifold center line 54 by (F3−F1) and the second fuel injection valve 41 is offset to the side of the engine center line 53 relative to the second cylinder center line 52 by fourth predetermined F4 and is offset to the side opposed to the engine center line 53 relative to the second intake manifold center line 55 by (F4−F2).

Both of the first and second fuel injection valves 27 and 41 are of a 2-direction injection type for injecting fuel into directions respectively by predetermined angles.

The offset amount F3 of the first fuel injection valve 27 constitutes a limit for bringing an end portion 32*a* of an injection range of the portion of fuel 32 into contact with an inner wall of the opening portion 28.

Further, the offset amount F4 of the second fuel injection valve 41 constitutes a limit for bringing an end portion 44*a* of an injection range of the portion of fuel 44 into contact with an inner wall of the opening portion 42.

As has been explained above, the invention is characterized in the engine 10 being of a style in which the first and the second fuel injection valves 27 and 41 of the 2-direction injection type are attached to the first and the second intake manifolds 16 and 17. Fuel is injected into the first and second combustion chambers 23 and 35 having the two opening portions 28 and 31 and the two opening portions 42 and 43 are aligned along the cam shafts 58, wherein the axis lines 56 and 57 of the first and the second fuel injection valves 27 and 41, are offset from the first and second cylinder center lines 51 and 52 of the first and the second combustion chambers 23 and 35 by a way of moving the first and the second fuel injection valves 27 and 41 along the cam shafts 58, while constituting the limits by bringing the fuel injection ranges of the first and second fuel injection valves 27 and 41 into contact with the inner walls of the opening portions 28 and 31 and the opening portions 42 and 43.

By the above-described constitution, for example, even in the case in which positions of the first and the second intake manifolds 16 and 17 are obliged to move from the first and the second cylinder center lines 51 and 52 along the cam shafts 58, the portions of fuel 32 and 33 and the portions of fuel 44 and 45 injected from the first and second fuel injection valves 27 and 41 can be made to be difficult to adhere to the inner walls of the opening portions 28 and 31 and the opening portions 42 and 43 and vaporization of the portions of fuel 32, 33, 44 and 45 can be expedited. Therefore, the mixture in the first and the second combustion chambers 23 and 35 can be made uniform and engine performance such as response performance of engine rotation, fuel consumption, exhaust gas properties, occurrence of knocking or the like when a throttle valve provided at the throttle body 18 is opened, can be improved.

Figure 3:
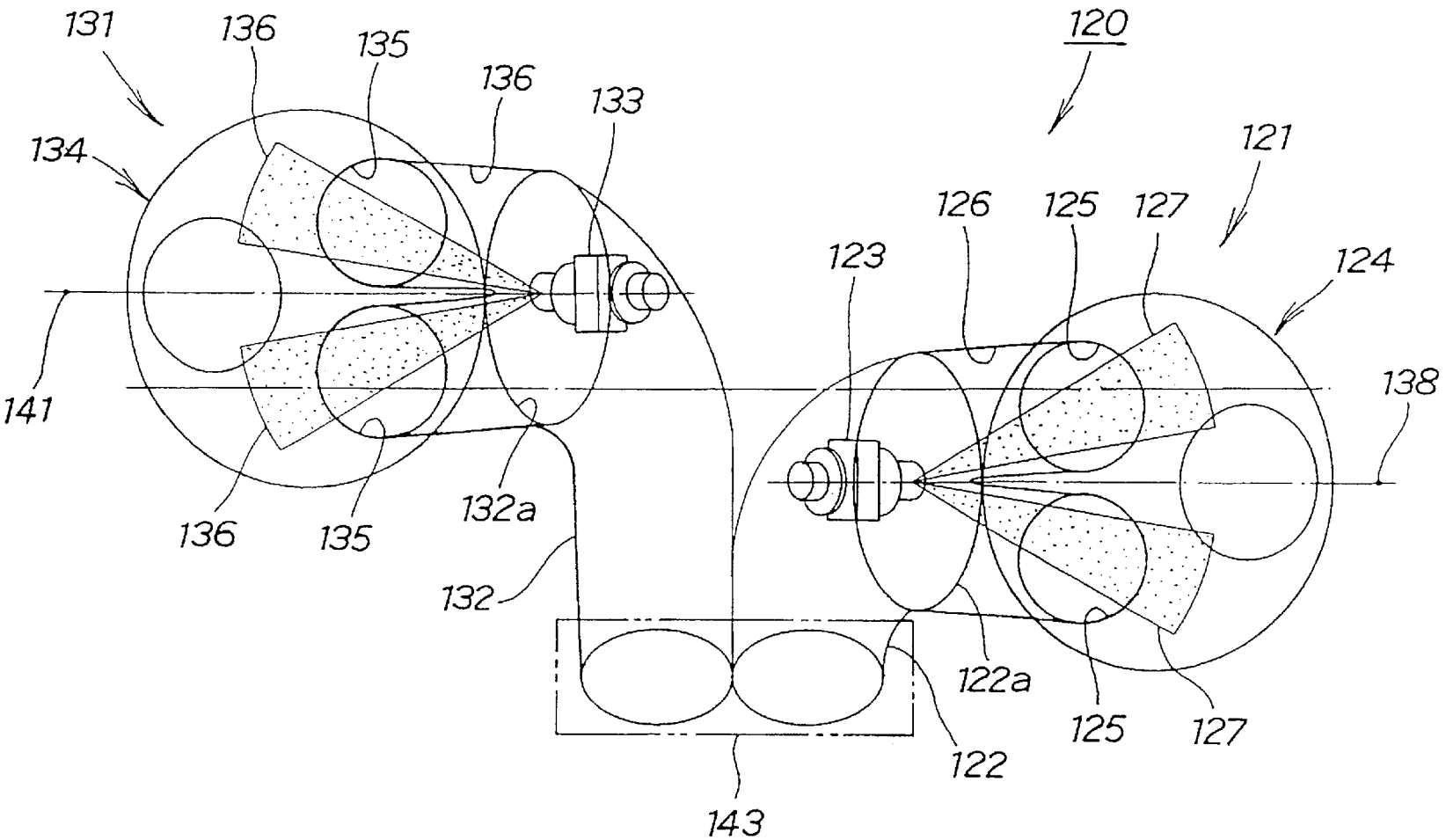
FIG. 3 is a plane view of essential portions of an engine showing a comparison example of a structure of arranging a fuel injection valve.
Figure 4:
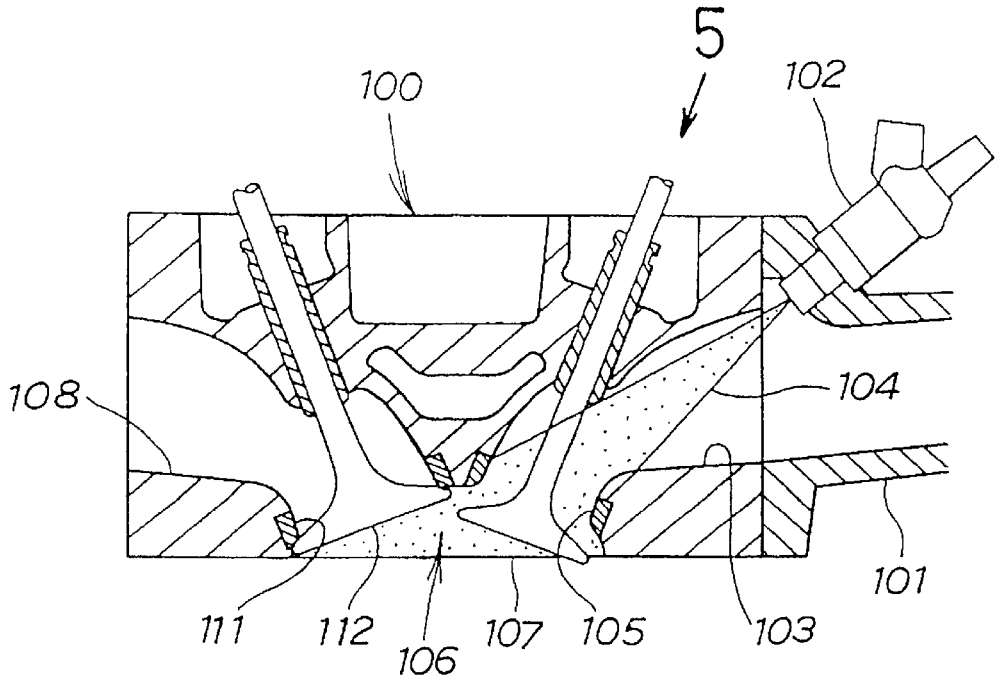
FIG. 4 is a sectional view showing a fuel injection state of a conventional engine.

FIG. 3 is a plane view of essential portions of an engine showing a comparison example of a structure of arranging a fuel injection valve. FIG. 3 illustrates a state in which a first intake manifold 122 is attached to a first cylinder head 121 of a V-type 2-cylinder engine 120 and a first fuel injection valve 123 is attached to the first intake manifold 122. An intake path 126 is provided with opening portions 125 opening to a first combustion chamber 124. Portions of fuel 127 are injected from the first fuel injection valve 123 to the opening portions 125. Similarly, a second intake manifold 132 is attached to a second cylinder head 131. A second fuel injection valve 133 is attached to the second intake manifold 132. An intake path 136 is provided with opening portions 135 opening to a second combustion chamber 134. Portions of fuel 136 are injected from the second fuel injection valve 133 to the opening portions 135. Further, a first cylinder center line 138 indicates a center of the first combustion chamber 124 and a second cylinder center line 141 indicates a center of the second combustion chamber 134.

The first intake manifold 122 connects a throttle body 143 and the first cylinder head 121 and the second intake manifold 132 is longer than the first intake manifold 122 and connects the throttle body 143 and the second cylinder head 131.

According to the first fuel injection valve 123, an axis line thereof coincides with the first cylinder center line 138 and the center of an outlet 122*a* of the first intake manifold 122 and according to the second fuel injection valve 133, an axis line thereof is made to coincide with the second cylinder center line 141 and the center of an outlet 132*a* of the second intake manifold 132.

According to the engine 120, two of the first and the second combustion chambers 124 and 134 are offset in a direction along a crankshaft (up and down direction of the drawing) and therefore, the lengths of the first intake manifold 122 and the second intake manifold 132 differ from each other. A difference is produced between intake air amounts of the first and second combustion chambers 124 and 134 and are characteristics of an efficiency of taking in air and a mixture (for example, a maximum value of an intake efficiency or an engine rotation number maximizing the intake efficiency) differ. Therefore, unbalance of output is produced among cylinders and the output is difficult to increase.

In contrast thereto, according to the V-type 2-cylinder engine 10 of the present invention shown in FIG. 2, there is constituted the V-type 2-cylinder engine offsetting the respective cylinders from each other in the crankshaft direction and arranging the throttle body 18 for two cylinders on one side of the engine 10 in the crankshaft direction, characterized in that the first fuel injection valve 27 facing the first combustion chamber 23 proximate to the throttle body 18, is offset in a direction of being remote from the throttle body 18 and the fuel injection valve 41 facing the second combustion chamber 35 the is remote from the throttle body 18, is offset to the side of the throttle body 18.

That is, the first and second fuel injection valves 27 and 41 are respectively offset from the first and second cylinder center lines 51 and 52 to sides proximate to each other.

By the above-described constitution, according to the engine 10 of the present invention, in the case in which in order to prolong the short first intake manifold 16 provided on the side of the first combustion chamber 23, the outlet 16*a* on the side of the intake path 24 is moved in the direction of being remote from the throttle body 18 and in order to shorten the second intake manifold 17 on the side of the second combustion chamber 35 that is longer than the first intake manifold 16 on the side of the first combustion chamber 24, the outlet 17*a* on the side of the intake path 36 is moved to the side of the throttle body 18 to thereby reduce the difference between the respective lengths of the first and the second intake manifolds 16 and 17, when the first fuel injection valve 27 is offset in the direction of being remote from the throttle body 18 and the second fuel injection valve 41 is offset to the side of the throttle body 18. The present invention improves engine performance such as engine response performance, fuel consumption, exhaust gas properties, occurrence of knocking or the like when the throttle valve provided in the throttle body 18 is opened. The difference between the intake air amounts of the first and the second combustion chambers 23 and 35 is reduced owing to substantially equal length formation of the first and the second intake manifolds 16 and 17 and the characteristics of the intake efficiency can be matched among the respective cylinders and the engine output can be increased.

Further, in the embodiment of the present invention, the structure of arranging a fuel injection valve is adopted in the V-type 2-cylinder engine, the engine is not limited thereto but the structure may be adopted to an engine of a V-type having a number of cylinders 4, 6, 8 or more, further, the structure may be adopted in other engine styles, for example, an in-line type or a horizontal opposed type.

According to the structure of arranging a fuel injection valve of an engine according to the present invention, the axis line of the fuel injection valve is offset from the center of the combustion chamber by way of moving the fuel injection valve along the cam shaft by constituting the limit by bringing the injection range of the fuel injection valve into contact with the inner wall of the intake hole. Therefore, even when the position of the intake manifold is obliged to move along the cam shaft, fuel injected from the fuel injection valve can be made to be difficult to adhere to the inner wall of the intake hole and vaporization of fuel can be expedited. Therefore, the mixture in the combustion chamber can be made uniform and engine performance such as response performance of engine rotation, fuel consumption, exhaust gas properties, occurrence of knocking or the like when the throttle valve is opened can be improved.

According to the structure of arranging a fuel injection valve of an engine according to the present invention, the engine is constituted by the V-type 2-cylinder engine offsetting the respective cylinders from each other in the crankshaft direction and arranging the throttle body for two cylinders on one side of the engine in the crankshaft direction, the first fuel injection valve facing the first combustion chamber proximate to the throttle body is offset in the direction of being remote from the throttle body, the second fuel injection valve facing the second combustion chamber remote from the throttle body, is offset to the side of the throttle body and therefore, for example, in the case in which in order to prolong the short intake manifold provided on the side of the first combustion chamber, an outlet thereof on the side of the intake path is moved in the direction of being remote from the throttle body and in order to shorten the intake manifold on the side of the second combustion chamber longer than the intake manifold on the side of the first combustion chamber, an outlet thereof on the side of the intake path is moved to the side of the throttle body to thereby reduce a difference between respective lengths of the intake manifolds, while improving engine performance, promotion of engine output can be achieved owing to the substantially equal length formation of the respective intake manifolds.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arrangement of a 2-direction injection type fuel injection valve relative to an engine comprising:

an intake manifold, said 2-direction injection type fuel injection valve being attached to said intake manifold for injecting fuel into a cylinder having two intake holes aligned along a cam shaft;

an axis line of the fuel injection valve being offset from a center line of the cylinder by positioning the fuel injection valve along a direction substantially parallel to the cam shaft;

a limit for limiting the positioning of the fuel injector valve along the direction substantially parallel to the cam shaft by bringing an injection range of the fuel injection valve into contact with an inner wall of the intake hole.

2. The arrangement of a 2-direction injection type fuel injection valve relative to an engine according to claim 1, wherein the engine is a V-type 2-cylinder engine offsetting respective cylinders from each other in a crankshaft direction and arranged with a throttle body for two of the cylinders on one side of the engine in the crankshaft direction, a first fuel injection valve facing a first combustion chamber proximate to the throttle body is offset in a direction of being remote from the throttle body and a second fuel injection valve facing a second combustion chamber remote from the throttle body is offset to a side of the throttle body.

3. The arrangement of a 2-direction injection type fuel injection valve relative to an engine according to claim 1, wherein the 2-direction injection type fuel injector is positioned to be displaced towards a direction of a center line of the engine from the center line of the cylinder.

4. The arrangement of a 2-direction injection type fuel injection valve relative to an engine according to claim 2, wherein a first 2-direction injection type fuel injector is positioned to be displaced towards a direction of a center line of the engine from the center line of a first cylinder of the V-type 2-cylinder engine and a second 2-direction injection type fuel injector is positioned to be displaced towards a direction of a center line of the engine from a center line of a second cylinder of the V-type 2-cylinder engine.

5. The arrangement of a 2-direction injection type fuel injection valve relative to an engine according to claim 3, wherein said 2-direction injection type fuel injector is offset from the center line of the cylinder by a first predetermined distance (F1).

6. The arrangement of a 2-direction injection type fuel injection valve relative to an engine according to claim 4, wherein said first 2-direction injection type fuel injector is offset from the center line of the first cylinder by a first predetermined distance (F1) and said second 2-direction injection type fuel injector is offset from the center line of the second cylinder by a second predetermined distance (F2).

7. The arrangement of a 2-direction injection type fuel injection valve relative to an engine according to claim 3, wherein said first 2-direction injection type fuel injector is offset from the center line of the first cylinder in a direction towards the center line of the engine by a third predetermined distance (F3).

8. The arrangement of a 2-direction injection type fuel injection valve relative to an engine according to claim 4, wherein said first 2-direction injection type fuel injector is offset from the center line of the first cylinder in a direction towards the center line of the engine by a third predetermined distance (F3) and said second 2-direction injection type fuel injector is offset from the center line of the second cylinder in a direction towards the center line of the engine by a fourth predetermined distance (F4).

9. The arrangement of a 2-direction injection type fuel injection valve relative to an engine according to claim 3, wherein said first 2-direction injection type fuel injector is offset to the side opposed to the engine center line to a first intake manifold center line by a distance equal to a third predetermined distance (F3) minus a first predetermined distance(F1).

10. The arrangement of a 2-direction injection type fuel injection valve relative to an engine according to claim 4, wherein said first 2-direction injection type fuel injector is offset to the side opposed to the engine center line to a first intake manifold center line by a distance equal to a third predetermined distance (F3) minus a first predetermined distance (F1) and said second 2-direction injection type fuel injector is offset to the side opposed to the engine center line to a second intake manifold center line by a distance equal to a fourth predetermined distance (F4) minus a second predetermined distance (F2).

11. An injection type fuel injection valve arranged relative to an engine comprising:

an intake manifold, said injection type fuel injection valve being attached to said intake manifold for injecting fuel into a cylinder aligned along a cam shaft;

an axis line of the fuel injection valve being offset from a center line of the cylinder by positioning the fuel injection valve along a direction substantially parallel to the cam shaft;

a limit for limiting the positioning of the fuel injector valve along the direction substantially parallel to the cam shaft to ensure that fuel ejected from the fuel injector valve does not adhere to an inner wall of an intake hole for said cylinder.

12. The arrangement of an injection type fuel injection valve relative to an engine according to claim 11, wherein the engine is a V-type 2-cylinder engine offsetting respective cylinders from each other in a crankshaft direction and arranged with a throttle body for two of the cylinders on one side of the engine in the crankshaft direction, a first fuel injection valve facing a first combustion chamber proximate to the throttle body is offset in a direction of being remote from the throttle body and a second fuel injection valve facing a second combustion chamber remote from the throttle body is offset to a side of the throttle body.

13. The arrangement of an injection type fuel injection valve relative to an engine according to claim 11, wherein the injection type fuel injector is positioned to be displaced towards a direction of a center line of the engine from the center line of the cylinder.

14. The arrangement of an injection type fuel injection valve relative to an engine according to claim 12, wherein a first injection type fuel injector is positioned to be displaced towards a direction of a center line of the engine from the center line of a first cylinder of the V-type 2-cylinder engine and a second injection type fuel injector is positioned to be displaced towards a direction of a center line of the engine from a center line of a second cylinder of the V-type 2-cylinder engine.

15. The arrangement of an injection type fuel injection valve relative to an engine according to claim 13, wherein said injection type fuel injector is offset from the center line of the cylinder by a first predetermined distance (F1).

16. The arrangement of an injection type fuel injection valve relative to an engine according to claim 14, wherein said first injection type fuel injector is offset from the center line of the first cylinder by a first predetermined distance (F1) and said second injection type fuel injector is offset from the center line of the second cylinder by a second predetermined distance (F2).

17. The arrangement of an injection type fuel injection valve relative to an engine according to claim 13, wherein said first injection type fuel injector is offset from the center line of the first cylinder in a direction towards the center line of the engine by a third predetermined distance (F3).

18. The arrangement of an injection type fuel injection valve relative to an engine according to claim 14, wherein said first injection type fuel injector is offset from the center line of the first cylinder in a direction towards the center line of the engine by a third predetermined distance (F3) and said second injection type fuel injector is offset from the center line of the second cylinder in a direction towards the center line of the engine by a fourth predetermined distance (F4).

19. The arrangement of an injection type fuel injection valve relative to an engine according to claim 13, wherein said first injection type fuel injector is offset to the side opposed to the engine center line to a first intake manifold center line by a distance equal to a third predetermined distance (F3) minus a first predetermined distance (F1).

20. The arrangement of an injection type fuel injection valve relative to an engine according to claim 4, wherein said first injection type fuel injector is offset to the side opposed to the engine center line to a first intake manifold center line by a distance equal to a third predetermined distance (F3) minus a first predetermined distance (F1) and said second injection type fuel injector is offset to the side opposed to the engine center line to a second intake manifold center line by a distance equal to a fourth predetermined distance (F4) minus a second predetermined distance (F2).

* * * * *